US010352651B1

(12) United States Patent
Vredenburg

(10) Patent No.: US 10,352,651 B1
(45) Date of Patent: Jul. 16, 2019

(54) HOLSTER FOR A CARRIED ITEM

(71) Applicant: CCW, LLC, Tijeras, NM (US)

(72) Inventor: Peter E. Vredenburg, Tijeras, NM (US)

(73) Assignee: CCW, LLC, Tijeras, NM (US)

( * ) Notice: Subject to any disclaimer, the term of this patent is extended or adjusted under 35 U.S.C. 154(b) by 0 days.

(21) Appl. No.: 15/948,613

(22) Filed: Apr. 9, 2018

(51) Int. Cl.
*F41C 33/02* (2006.01)
*A45F 5/02* (2006.01)
*F41C 33/04* (2006.01)

(52) U.S. Cl.
CPC ..... *F41C 33/0263* (2013.01); *F41C 33/0236* (2013.01); *F41C 33/048* (2013.01); *A45F 5/021* (2013.01); *A45F 2200/0591* (2013.01); *Y10S 224/912* (2013.01)

(58) Field of Classification Search
CPC .. F41C 33/02; F41C 33/0236; F41C 33/0245; F41C 33/0263; F41C 33/0272; F41C 33/0209; F41C 33/0218; F41C 33/0227; F41C 33/048; A45F 5/021; A45F 2200/0591; Y10S 224/912
See application file for complete search history.

(56) References Cited

U.S. PATENT DOCUMENTS 1,930,203 A * 10/1933 Jewett ..... F41C 33/0209 224/193
4,277,007 A 7/1981 Bianchi
4,299,045 A * 11/1981 Cervantes ..... F41A 17/74 42/70.07
D293,045 S * 12/1987 Merritt ..... D3/222
4,846,384 A * 7/1989 Perry ..... F41C 33/0227 224/244
5,621,996 A * 4/1997 Mowl, Jr. ..... F41A 23/18 211/64
5,687,891 A 11/1997 Beletsky
D392,364 S * 3/1998 Neal ..... D22/100
5,931,358 A 8/1999 Rogers
6,264,079 B1 7/2001 Skaggs
6,330,815 B1 * 12/2001 Duncan ..... B60R 7/14 211/4
8,684,242 B2 4/2014 Pomeroy
9,494,384 B2 11/2016 Rogers
9,835,410 B2 12/2017 Morgan
2013/0015225 A1 * 1/2013 Hogue ..... F41C 33/0218 224/587
2014/0027479 A1 * 1/2014 Hogue ..... F41C 33/0218 224/183

(Continued)

*Primary Examiner* — Justin M Larson
(74) *Attorney, Agent, or Firm* — Iron Gate Intellectual Property; Andres Salazar

(57) ABSTRACT

A holster for a wide range of carried items including revolver-type and semiautomatic handguns of various types, models and calibers, pepper- and mace-spray, and other similarly configured items, the holster ambidextrous and adaptable to be worn in various user preferred carry modes and positions. The holster having an interior space created by hinged first and second side plates having a plurality of receptacles accommodating universal securing of carried item and multiple options for attachment points for body mounting facilities. Selectable hinge knuckles, spring-biased opening and adjustable latch provide user-configurable expandable holster capacity for secure carry containment and ease of retrieval of various carried items.

20 Claims, 10 Drawing Sheets

(56) References Cited

U.S. PATENT DOCUMENTS

| | | | | |
|---|---|---|---|---|
| 2014/0252055 | A1* | 9/2014 | Rogers | F41C 33/0263<br>224/244 |
| 2015/0345898 | A1 | 12/2015 | Bardy | |
| 2015/0345899 | A1 | 12/2015 | Bardy | |
| 2016/0135575 | A1 | 5/2016 | Solomon | |
| 2017/0191794 | A1 | 7/2017 | Garibaldi | |
| 2017/0292808 | A1* | 10/2017 | Chambers | A45C 11/22 |
| 2018/0180380 | A1* | 6/2018 | Catner | F41C 33/0209 |
| 2019/0128640 | A1* | 5/2019 | Shinkle | F41C 33/041 |

* cited by examiner

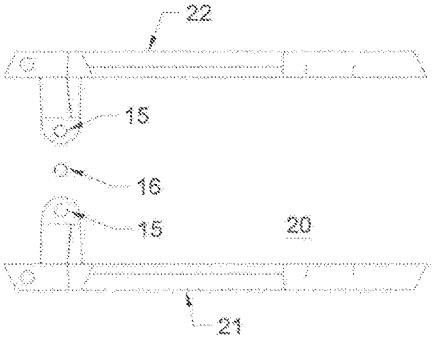
fig. 5A
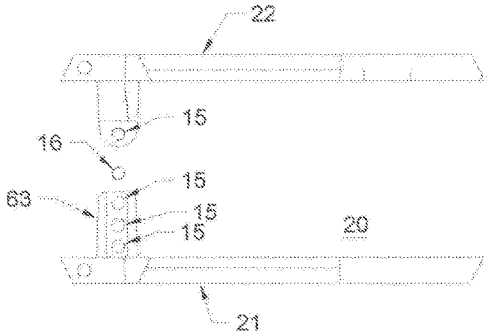
fig. 5B
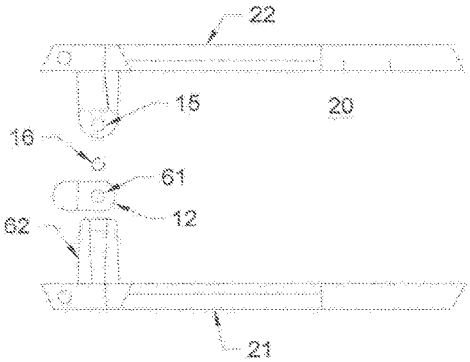
fig. 5C
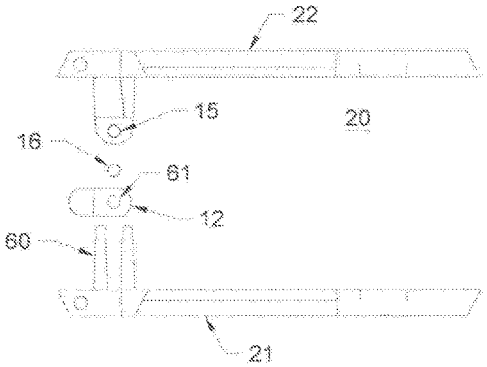
fig. 5D
FIG. 5

HOLSTER FOR A CARRIED ITEM

FIELD OF THE INVENTION

The present invention relates to holsters for carried items, and more particularly to holsters that securely contain, yet offer easy access to when needed and can accommodate a wide range of carried items such as various handgun types, models and calibers, and taxers, pepper spray, mace and similar items.

BACKGROUND OF THE INVENTION

Holsters are generally designed to offer protection to the handgun, secure its retention, and provide ready access to it. The need for ready access is often at odds with the need for security and protection, so the user must consider the individual's needs. If the shape of the holster and materials are chosen to optimize the retention of the handgun, the ability to quickly and smoothly retrieve it may be difficult. Choosing the right balance can be very important, especially in the case of a defensive weapon holster, where failure to access the weapon quickly or damage or loss of the weapon due to insufficient retention or protection could result in serious injury or death to the user.

Holsters are generally designed to be used with one hand, allowing the handgun to be removed and/or replaced with the same hand. To be able to return the handgun to its holster one-handed, the holster must be made from stiff material that holds its shape so that the holster won't collapse when the object is no longer inside to give it support.

Holsters are generally attached to a person's belt or waistband, clipped to another article of clothing or are attached to a strap, which in turn is worn around a person's body where it is immediately accessible. Holsters are generally worn in a location where they can be readily accessible. Common locations are: at the waist (outside (OWB) or inside (IWB) the waistband), behind the back (small of back (SOB)), at the ankle, at the chest (in an elastic belly band or shoulder holster), or on the upper thigh. Furthermore, holsters may be worn in either a left- or right-hand position.

As carry and concealed carry have become more popular in the general public, there has come a need for better performing holsters that provide many of the previously mentioned features in a single package. Furthermore, holsters have been designed for optimal performance on a specific model as each type and model of handgun varies in size, shape and location of key components, such as the trigger, length of the barrel and other features. Concealed holsters, even those touted as being "universal", usually accommodate only a limited range of weapons without purchasing additional adapters or complete holsters for weapon styles, designs, carry mode, or angle-of-carry. Holsters that attempt to provide security of the handgun while allowing quick access for a variety of types or models end up compromising on one or more performance objectives while still only accommodating a select few models.

It is therefore a present need for a holster that can secure a handgun and provide ready access, and furthermore, a need for a holster that can accommodate ambidextrous use and a wide variety of types and models of handguns and other carried items, as well as allow for a variety of carry modes and position preferences of the user.

BRIEF DESCRIPTION OF THE INVENTION

The present invention provides an improved holster capable of solving the present need stated above. As such, the general purpose of the present invention, which will be described subsequently in greater detail, is to provide an improved holster that overcomes the need to make the tradeoffs mentioned above.

To attain this, the preferred embodiment of the present, invention essentially comprises a configurably-hinged holster having an open-biased set of side plates defining an interior space arranged to receive and secure a carried item, such as a handgun, pepper spray, taser or similar item. The configurable hinge feature allows the holster to accommodate a wide variety of carried item makes and models, as well as facilitates ease of securing and deployment by presenting an easily accessible interior space. The interior space includes at least one registration pin sized and located by a multitude of through-hole receptacles in the side plates to firmly locate the carried item between the surface defined by the hinge and the line defined by the registration pin contact with the trigger guard or carried item frame adjacent to the trigger guard. An additional level of security is provided by a latch that holds the hinged side plates in parallel, capturing the carried item within the holster. The latch assembly is mounted such that it protrudes through the trigger guard of the carried item, thus preventing the carried item from being withdrawn from the holster when the side plates are latched together.

The carried item is easily drawn from the holster when the user depresses a push button release on the latch, whereupon a biasing spring separates the plates and provides ample access to the interior space for retrieving the carried item. A carried item is easily secured in the holster by inserting the carried item into the interior space, then drawing the side plates together until the latch engages.

The holster's width-adjustable hinge, length adjustable latch and locatable registration pins provide a highly configurable interior space for accommodating various types, models and sizes of carried items. Furthermore, the holster is adaptable to many alternative types of body mounting facilities, including facilities using paddles that tuck in a user's pants, clips for belts, strap assemblies for thigh holsters, shoulder holsters, and ankle holsters, and frames and shrouds for inside-the-waistband carry (MB). The through-hole receptacles within the side plates in conjunction with an adapter plate provide multiple options for attachment points for the body mounting facilities in either a left- or right-hand carry position.

The present invention also includes a method for securing and releasing a carried item, such as a handgun, utilizing a configurable, latchably-hinged holster.

There are, of course, additional features of the invention that will be described hereinafter and which will form the subject matter of the claims attached. The detailed description thereof that follows provides a better understanding of the present invention, and in such order that the present contribution to the art may be better appreciated.

BRIEF DESCRIPTION OF THE DRAWINGS

FIG. 5 is a top view of the side plates separated to depict embodiments of the hinge configurations of the present invention, FIG. 5A circular knuckles, FIG. 5B adjacent knuckles, FIG. 5C elongated knuckles and FIG. 5D elongated open knuckles.

DETAILED DESCRIPTION OF THE INVENTION

Figure 1:
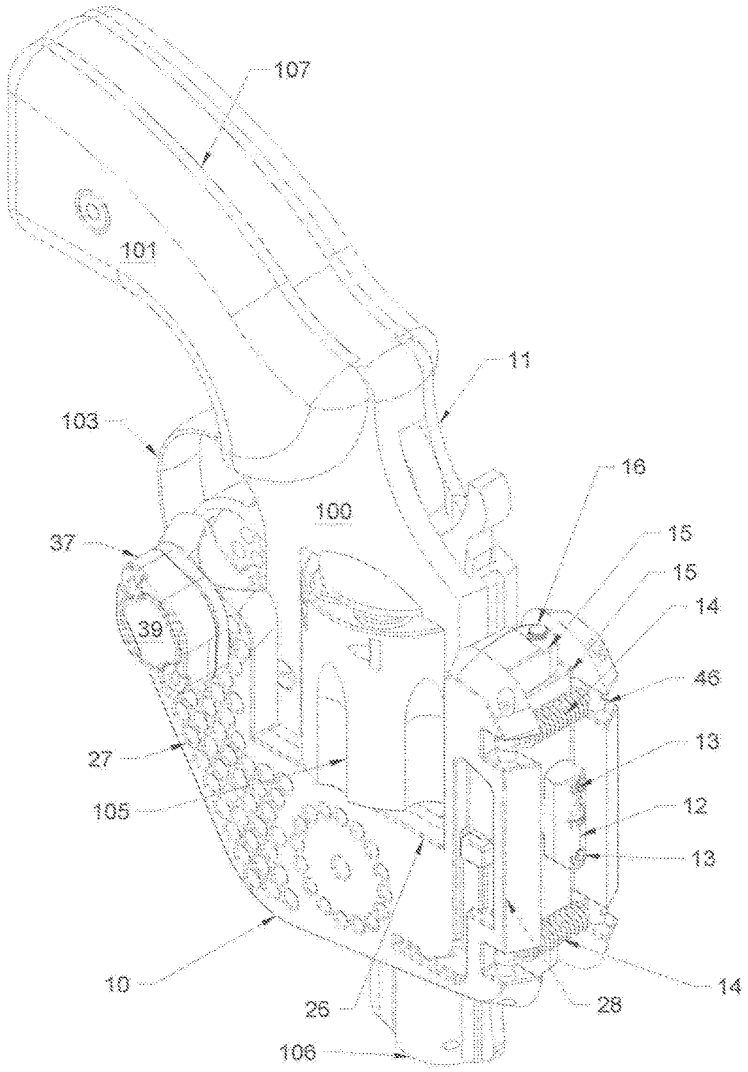
FIG. 1 is a side isometric view of the current embodiment of the holster in the closed position with a revolver-type carried item secured within the interior space of the holster.
Figure 4:
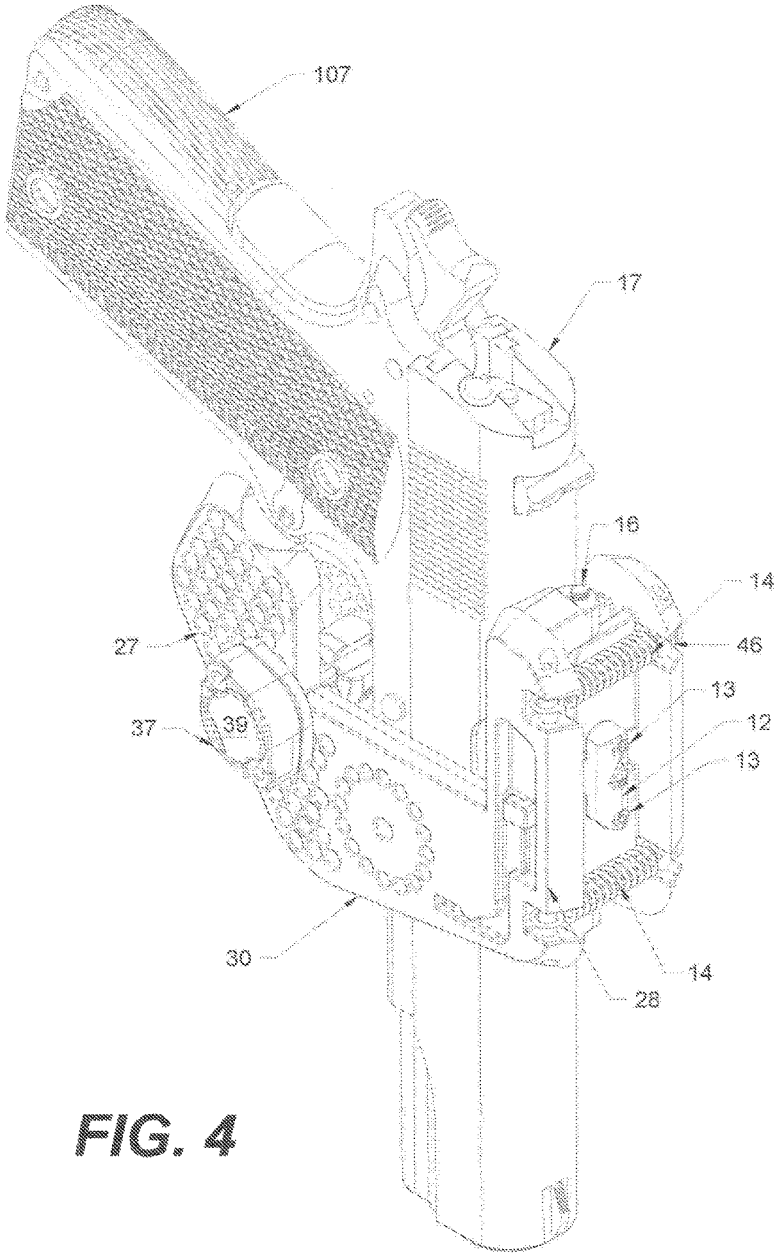
FIG. 4 is a side isometric view of the current embodiment of the holster in the closed position with a semi-automatic-type carried item secured within the interior space of the holster.
Figure 10:
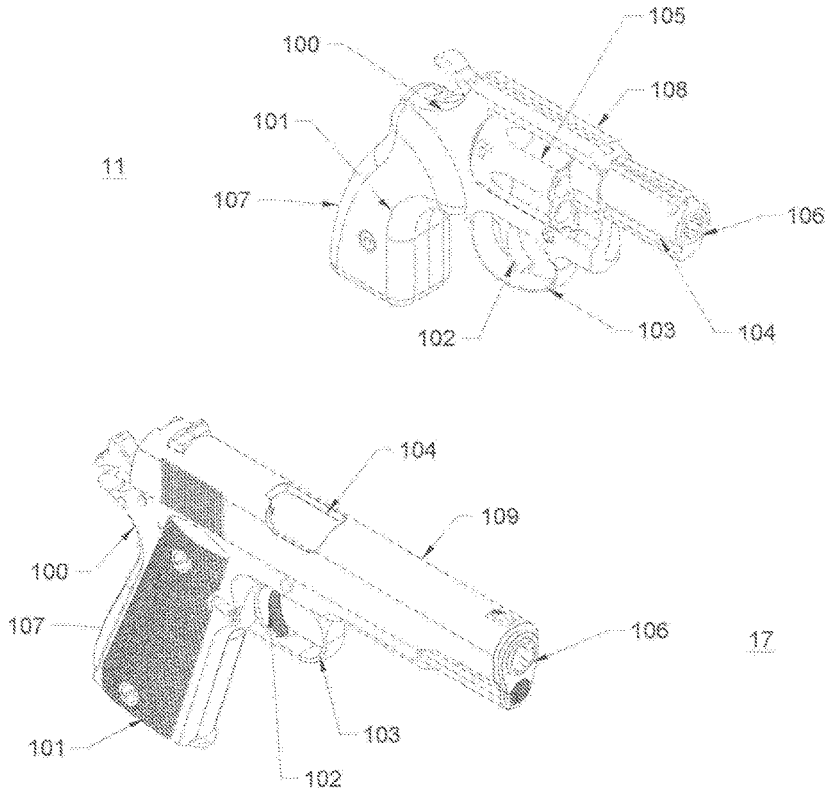
FIG. 10 depicts typical components of revolver- and semi-automatic-type carried items.

An embodiment of the holster of the present invention is shown and generally designated by the reference number 10. FIG. 1, FIG. 2, FIG. 3 and FIG. 4 depict the holster 10 in the closed and open positions. FIG. 1 depicts the holster 10 in the closed position securing a carried item, herein also referred to as a handgun 11 for concise descriptive purposes only. The carried item in FIG. 1 is a generic revolver-type handgun 11. As will be described later, the holster 10 is capable of being configured to provide high performance features for a range of carried items, including but not limited to revolver and semi-automatic handguns, pepper and mace spray products, tasers and similar items. FIG. 4 depicts the invention with a semi-automatic handgun 17. In the instant example, the handgun 11 has a frame 100, a grip 101, a trigger 102, a trigger guard 103 and a barrel 104. Revolver handguns also possess a cylinder 105 and a top strap 108. Semi-automatic handguns 17 also possess a slide 109. For purposes of the present invention, the top strap 108 on a revolver 11 and the slide 109 on a semi-automatic handgun 17 are both treated as part of the frame of the handgun 11. The muzzle end 106 of a handgun 11 is the same as the handgun forward end 106. The grip end 107 of a handgun 11 is the same as the handgun rear end 107. FIG. 10 depicts typical carried item elements for a revolver handgun 11 and a semi-automatic handgun 17. Other types of carried items possess similar features.

Figure 2:
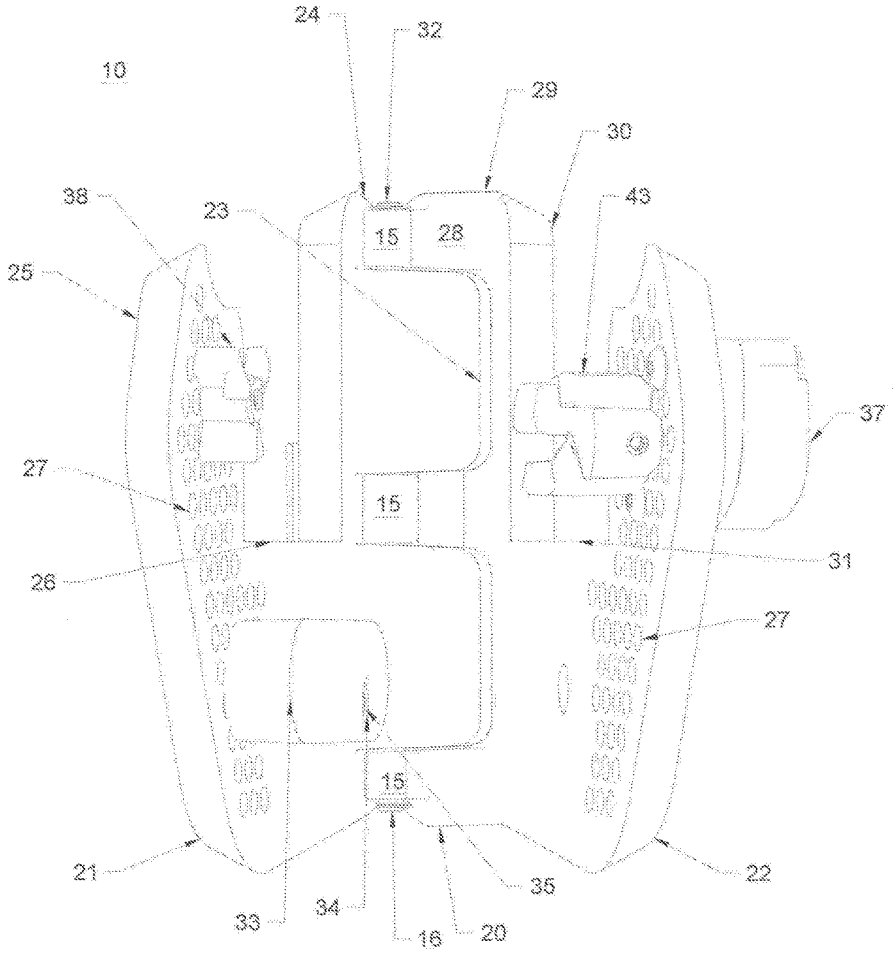
FIG. 2 is a rear view of the current embodiment of the holster in the open position ready to receive a carried item into the interior space of the holster or release a carried item from the interior space of the holster.
Figure 3:
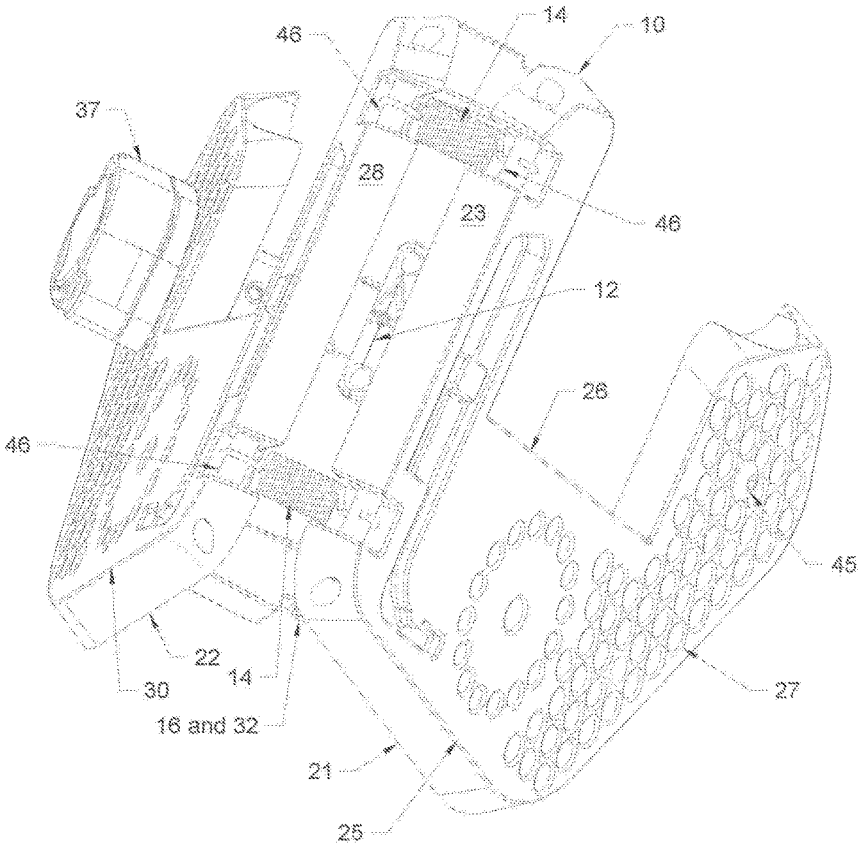
FIG. 3 is a front isometric view of the current embodiment of the empty holster in the open position.

FIG. 2, depicts the holster 10 in the open position ready to receive or release the handgun 11. The holster 10 has an interior space 20, see also FIG. 5, created by the joining of a first side plate 21 and a second side plate 22 along the first side plate front portion 23 and the second side plate front portion 28 by a removable hinge pin 16 that is inserted through cooperative hinge knuckles 15, reference FIG. 5A, on the first side plate front portion 23 and on the second side plate front portion 28, thus allowing the first side plate 21 and the second side plate 22, respectively, to be axially joined. The interior space 20 created between the first side plate 21 and the second side plate 22 allows for the receiving, securing and releasing of the handgun 11.

The arrangement of the axially joined first side plate 21 and second side plate 22 is such that each of the side plates makes maximum surface contact with the sides of the handgun frame 100 or carried item in order to effect a proper lateral and rotational securing of the handgun 1 when the holster 10 is closed. Maximum contact is achieved when the first side plate 21 and the second side plate 22 are substantially parallel when the holster 10 is in the closed position securing the handgun 11.

Each of the first side plate top portion 24 and the second side plate top portion 29 have a notch, 26 and 31 respectively, for receiving the cylinder 105 of a revolver-type handgun 11. As a result, the holster 10 is capable of receiving and securing either revolver-type or semi-automatic-type handguns as well as other carried items of various configurations. The first side plate 21 and second side plate 22 each have an exterior surface, respectively the first side plate exterior surface 25 and the second side plate exterior surface 30, that are defined as the side of each respective side plate that is opposite the interior space 20.

Preferred properties of holsters include that they be protective of the carried item's surface, lightweight, rigid, thermally non-conductive, immune to normal body chemistries and economically manufacturable. Hard plastics, thermal plastics, printed plastics, nylon and sintered nylon are some of the materials easily adapted to the present invention. However, other similar materials would suffice for construction of the first side plate 21 the second side plate 22, and cooperative hinge knuckles 15.

Figure 6:
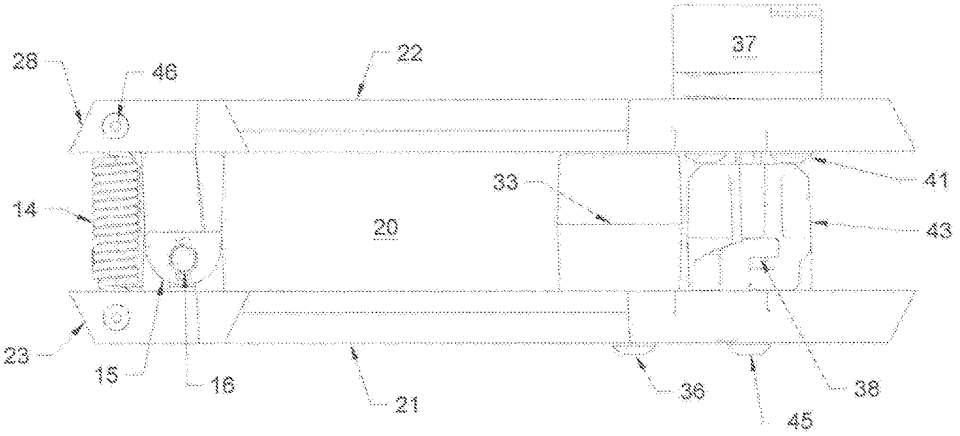
FIG. 6 is a top view of the holster.

A pair of tension springs 14 connect to spring retention pins 46 located on the first side plate front portion 23 and on the second side plate front portion 28 orthogonal to and at a distance from the removable hinge pin 16, thereby applying an equal and opposite moment of force to the first side plate 21 and the second side plate 22 about the axis 32 created by the removable hinge pin 16, and thus biasing the first side plate 21 and the second side plate 22, to experience axial rotation away from each other and biasing the holster 10 to an open position for allowing access to the interior space 20 for receiving or releasing a handgun 11. FIG. 6 depicts the orthogonal relationship between the tension springs 14 and the removable hinge pin 16.

An alternate embodiment to bias the holster into the open position includes positioning a compression spring, not shown, coupling the first side plate 21 and the second side plate 22 by locating the compression spring orthogonal to and at a distance from the removable hinge pin 16 within the interior space 20 of the holster 10. Still another embodiment includes positioning a torsion spring, not shown, in axial alignment with the cooperative hinge knuckles 15 through which the removable hinge pin 16 is inserted, with the ends of the torsion spring, not shown, in contact with the first side plate 21 and the second side plate 22 within the interior space 20 of the holster 10 thereby biasing the first side plate 21 and the second side plate 22, to experience axial rotation away from each other and biasing the holster 10 to an open position for allowing access to the interior space 20 for receiving or releasing a handgun 11.

Figure 9:
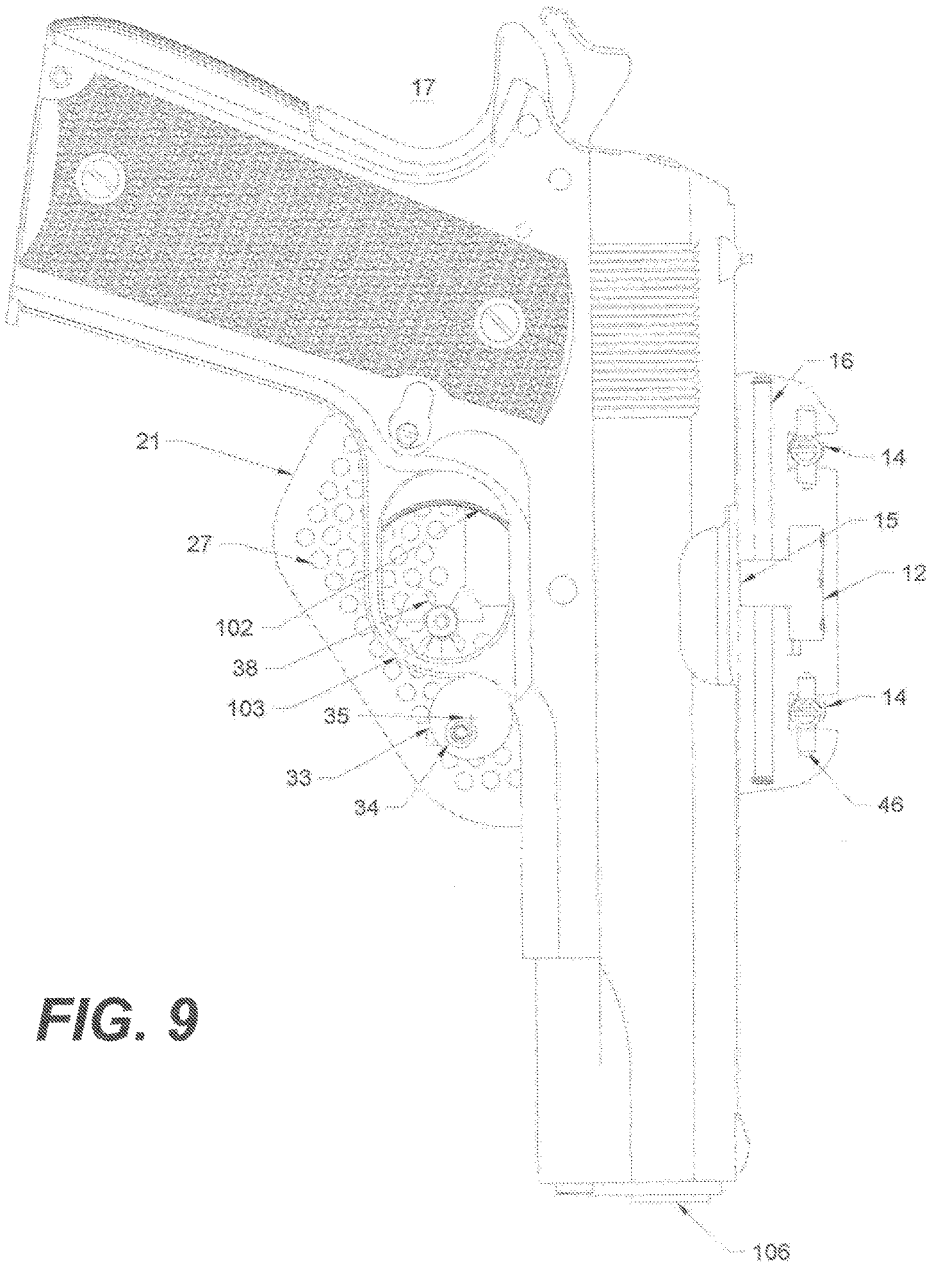
FIG. 9 is a cut away side view of the holster depicting a semi-automatic handgun in a holstered position.

Both the first side plate 21 and the second side plate 22 possess a plurality of through-hole receptacles 27, on to which a registration pin 33 may be removably attached. The registration pin 33 is located within the interior space 20 of the holster 10 removably attached to either the first side plate 21 or the second side plate 22 by a registration pin retaining screw 36 placed through one of the through-hole receptacles 27 and threaded into a registration pin receiving nut 34 within the registration pin 33. The receiving nut 34 within the registration pin 33 is located off-center of the registration pin axis 35, reference also FIG. 9, so that the final location of the registration pin 33 can be fine-tuned by rotating the registration pin 33 prior to final tightening of the screw 36. The registration pin 33 may generally be placed at any location within the interior space 20 by choosing which through-hole receptacles 27 to use. The location of the registration pin 33 and choice of which through-hole receptacles 27 to use is determined by the physical characteristics of the carried item and the user preferred carry position.

In order that the handgun 11 be properly secured when the holster 10 is in the closed position, the handgun 11 must be restricted in movement within the interior space 20 of the holster 10. In the current embodiment, lateral and rotational movement of the handgun 11 is restricted by positive contact of both of the first side plate 21 and second side plate 22 with the handgun frame 100 when the holster 10 is in the closed position. Movement of the handgun 11 in the handgun forward end 106 direction is restricted by the handgun 11 contact with the cooperative hinge knuckles 15 along the barrel 104 and frame 100 of the handgun 11, and the registration pin 33 contact with the trigger guard 103, or the frame 100 adjacent to the trigger guard 103, which is achieved by locating the registration pin 33 in the proper through-hole receptacles 27 where the surface of the registration pin 33 makes positive contact with the handgun trigger guard 103, or the frame 100 adjacent to the trigger guard 103, and establishes a user-preferred position of the handgun 11 within the interior space 20 of the holster 10. The registration pin 33 is then further adjusted by rotating it about its off-center receiving nut to provide a snug fit against the trigger guard 103 or the adjacent frame 100.

A latch, more specifically in the current embodiment, a push-button rotary draw latch 37, is removably attached to either the first side plate 21 or the second side plate 22 in alignment with, and engageable with, a latch keeper 38 removably attached to the opposing side plate, and configured such that the first side plate 21 and the second side plate 22 are substantially parallel when latched and the holster 10 is in the closed position. Both the push-button rotary draw latch 37 and the latch keeper 38 are each secured to either of the first side plate 21 or second side plate 22 by screws, two screws 41 for the latch and one screw 45 for the latch keeper, fitting through appropriately located through-hole receptacles 27 and threaded into the push-button rotary draw latch receiving nuts 49 and latch keeper receiving nuts 44, respectively. The shaft 40 is designed to protrude through one of the through-hole receptacles 27 of either the first side plate 21 or the second side plate 22, so that the push button 39 is located on the first side plate exterior surface 25 or the second side plate exterior surface 30 in order to accommodate either a left- or right-handed use.

Figure 7:
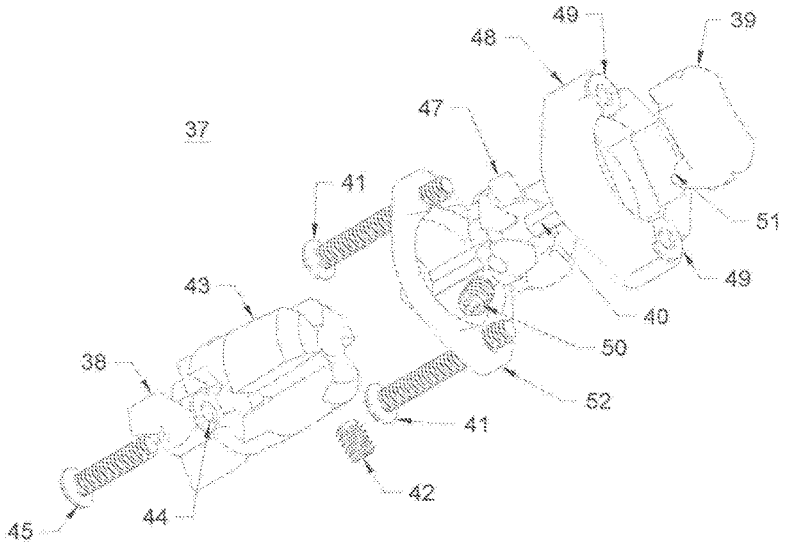
FIG. 7 is a side isometric view of the push-button rotary draw latch.

Referencing FIG. 7, the push-button rotary draw latch 37 is shown in exploded view. The push-button rotary draw latch 37 engages and disengages the latch bolt 43 from the latch keeper 38 by a rotary action as opposed to a plunger and spring-biased latch bolt action on a typical draw latch. Either design provides the desired function for the present invention. The current embodiment comprises the push-button rotary draw latch 37. The push-button rotary draw latch 37 comprises a latch bolt 43 slideably attached to a shaft 40 by a set screw 42 such that the position of the latch bolt 43 along the shaft 40 is adjustable. The shaft 40 comprises a shaft sliding gear 47, adjustably secured to the shaft 40 with a set screw 50, the shaft sliding gear 47 in communication with a push-button 39 comprising a complementary push-button sliding gear 51. The shaft sliding gear 47 is position-biased by a locking spring 52. Depression of the push-button 39 rotates the latch bolt 43 from an engaged position to a disengaged position from the latch keeper 38.

The location of the push-button rotary draw latch 37 and choice of which through-hole receptacles 27 to use is determined by the physical characteristics of the carried item, or in the instant example, the handgun 11. In the present invention, the proper through-hole receptacles 27 for removably attaching the push-button rotary draw latch 37 is chosen by the user so that the push-button rotary draw latch 37 extends through the trigger guard 103, and preferably closely against the handgun forward end 106 of the trigger guard 103 or the frame 100 adjacent to the trigger guard 103. In this position, movement of the handgun 11 in the handgun rear end 107 direction is restricted by the handgun trigger guard 103 contact with the push-button rotary draw latch 37.

Thus, the combination of the first side plate 21, the second side plate 22, the cooperative hinge knuckles, the registration pin 33 and the push-button rotary draw latch 37 establishes a secured, user-preferred position of the handgun 11 within the interior space 20 of the holster 10 when the holster 10 is in the closed position. Activation of the rotary draw latch push-button 39 disengages the push-button rotary latch bolt 43 from the latch keeper 38 and allows the moment of force applied by the tension springs 14 to open the holster 10 and thereby permits easy access to the interior space 20 of the holster 10 for receiving or releasing of a handgun 11 or other carried item.

Figure 8:
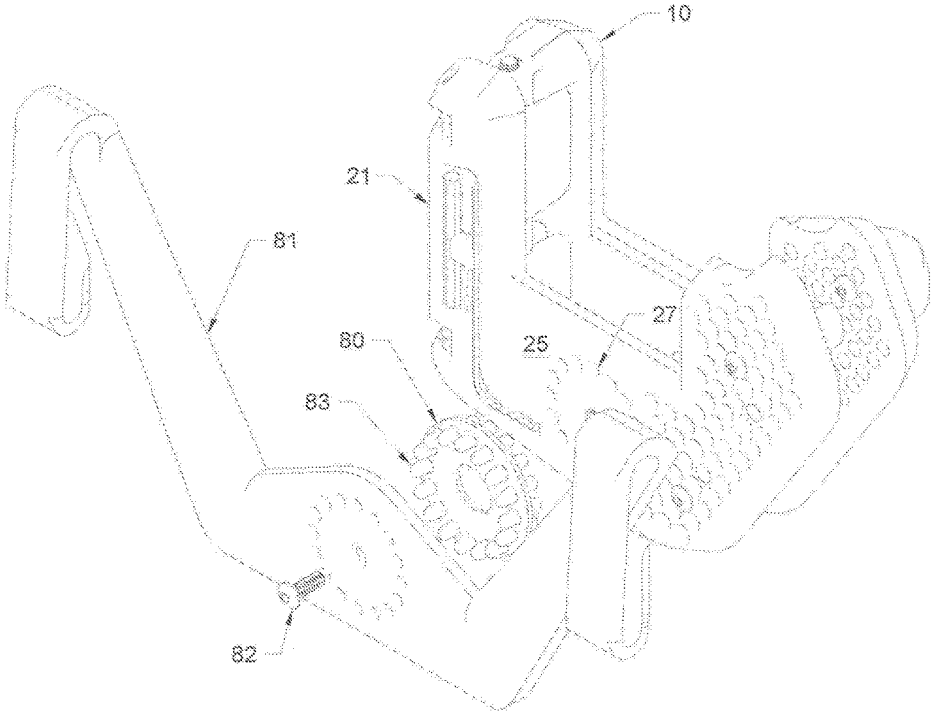
FIG. 8 is a side isometric view of the holster depicting a body mounting facility.

Referencing FIG. 8, a side isometric view of the holster 10 shows an example means of body mounting facility for the holster 10. In the current embodiment, an adapter plate 80 having adapter pins 83 is attached into the through-hole receptacles 27 on either the first side plate exterior surface 25 or the second side plate exterior surface 30, depending on if the user is left- or right-handed. In addition, the adapter plate 80 has adapter pins 83 on the opposite side of the adapter plate 80 that fit into a IWB/OWB belt accessory 81 in any of multiple angles preferred by the user. It is understood that the adapter plate may attach to the holster 10 in any number of ways, including screws, as well.

The holster 10 in the current embodiment is adaptable to many alternative types of body mounting facilities, including facilities using paddles that tuck in a user's pants, clips for belts, strap assemblies for thigh holsters, shoulder holsters, and ankle holsters, and frames and shrouds for inside-the-waistband carry (IWB). For example, the through-hole receptacles 27 on either the first side plate 21 or the second side plate 22 in conjunction with an adapter plate 80 attached by a screw 82 provide multiple options for attachment points for the body mounting facilities in either a left- or right-hand carry position. Other body mounting facilities and methods are widely known to those of skill in the art.

In, the preferred embodiment or best mode, the cooperative hinge knuckles 15 on either the first side plate 21 or the second side plate 22 have open-ended elongated knuckles, reference. FIG. 5D, to form open-ended elongated cooperative hinge knuckles 60, and furthermore, possess a location-adjustable width lock 12 having a circular knuckle 61 that is slideably aligned with the open-ended elongated cooperative hinge knuckles 60. The location of the width lock is adjustably secured with set screws 13 against the sides of the open-ended elongated cooperative hinge knuckles 60. This provides the advantage of almost infinite adjustment of the interior space 20 while keeping the first side plate 21 and second side plate 22 substantially in parallel when the holster 10 is in the closed position. Absent this ability for the user to adjust the interior space 20, the first side plate 21 and the second side plate 22, in cooperation, are less effective in accommodating narrower- and wider-framed handguns and carried items. The ability to user-configure the interior space 20 while maximizing the holster 10 surface contact with the handgun 11 provides one of the distinctive advantages of the present inventions' ability to secure a much wider variety of handguns and other carried items. In an alternate embodiment, the cooperative hinge knuckles 15 are elongated cooperative hinge knuckles 62, reference FIG. 5C, however, they are not open-ended. This configuration also provides for almost infinite adjustment of the interior space.

In addition, the latch bolt 43 of the push-button rotary draw latch 37 of the preferred embodiment is slideably attached onto the shaft 40 and can be adjustably secured with a set screw 42 so that the push-button rotary draw latch 37 is capable of effecting an adjustable draw length. The combination of the open-ended elongated cooperative hinge knuckles 60 and the adjustable draw length of the push-button rotary draw latch 37 allows a user-adjustable size of the interior space 20 while keeping the first side plate 21 and the second side plate 22 substantially parallel when the holster 10 is in the closed position for securing and providing ready access to a handgun 11 and, and furthermore, accommodates a wide variety of types and models of carried items, and is capable of positioning the handgun 11 to the preferences of the user.

In the best mode, the user configures the holster 10 by inserting the removable hinge pin 16 through the open-ended elongated cooperative hinge knuckles 60 to axially connect the first side plate 21 to the second side plate 22, places a carried item such as a handgun 11 into the interior space 20 of the holster 10 in a preferred carry position, then draws the first side plate 21 and the second side plate 22 together. The width of the holster 10 is then set by sliding the width lock 12 between the open-ended elongated cooperative hinge knuckles 60 until the plates are substantially parallel, then securing the width lock 12 with the set screws 13 against the sides of the open-ended elongated cooperative hinge knuckles 60. An appropriately lengthened registration pin 33 is then selected and positioned at the appropriate through-hole receptacles 27 of either of the first side plate 21 or the second side plate 22 within the interior space 20 where the surface of the registration pin 33 makes positive contact with the handgun forward end 106 of the handgun trigger guard 103, or the frame 100 adjacent to the trigger guard 103, which fixes the user-preferred position of the handgun 11 within the interior space 20 of the holster 10, whereupon the user loosely fits the registration pin with a screw 36. The registration pin 33 is then further adjusted by rotating it about its off-center receiving nut 34 to provide a snug fit against the trigger guard 103, and the screw 36 fully tightened.

With the first side plate 21 and the second side plate 22 still drawn together, the user then assembles the push-button rotary draw latch 37 into the proper through-hole receptacles 27 through either of the first side plate exterior surface 25 or the second side plate exterior surface 30, depending on whether the user is left- or right-handed, so that the push-button rotary draw latch 37 extends through the trigger guard 103, and preferably closely against the handgun forward end 106 of the trigger guard 103 and secures its position with screws 41. The user then adjusts the length of the push-button rotary draw latch 37 by extending the latch bolt 43 along the shaft 40 until it engages with the latch keeper 38, whereupon the user tightens the set screw 42 such that the push-button rotary draw latch 37 holds the holster 10 in the closed position securing the carried item. In order to retrieve the handgun 11, the user depresses the push-button 39 which disengages the latch bolt 43 from the keeper 38, allowing the tension springs 14 to open the holster 10, whereupon the user simply retrieves the handgun 11 from the holster 10. Once the width lock 12, the registration pin 33 and the push-button rotary draw latch 37 have been set for a specific handgun 11, securing and retrieval of the handgun 11 is accomplished by simply inserting the handgun 11 into the holster 10, drawing the holster 10 into a closed position until it, latches, then depressing the push-button 39 to open the holster 10 and retrieve the handgun 11.

In a different embodiment, the cooperative hinge knuckles 15 on either the first side plate 21 or the second side plate 22 are comprised of multiple adjacent knuckles 63, reference FIG. 5B, through which the user inserts the removable hinge pin 16 through the selected knuckles of the multiple adjacent knuckles 63 in order to fix the width of the holster 10. In this embodiment, no width lock 12 is needed.

In a simpler embodiment of the invention used for inside the waistband carry (IWB), there is not necessarily a need for a latch. When the holster is worn the inside the waistband, the first side plate 21 and the second side plate 22 are held in the closed position by the user's body and waistband thus restricting the lateral and rotational movement of the handgun 11, while movement of the handgun 11 in the handgun forward end XX direction is restricted by the handgun 11 contact with the cooperative hinge knuckles 15 along the barrel 104 and frame 100 of the handgun 11 and the handgun trigger guard 103, or the frame 100 adjacent to the trigger guard 103, contact with the registration pin 33 by locating the registration pin 33 in the proper through-hole receptacles 27 where the surface of the registration pin 33 makes positive contact with the handgun trigger guard 103, or the frame 100 adjacent to the trigger guard 103, and establishes a user-preferred position of the handgun 11 within the interior space 20 of the holster 10. The holster remains fully adjustable to accommodate multiple types and models of handguns and other carried items via adjustment of the width lock 12 and appropriate knuckle selection from the multiple adjacent knuckles 63, or adjustment of the elongated hinge knuckles 62 or open-ended elongated hinge knuckles 60, and selection of an appropriately positioned and lengthened registration pin 33 in order to orient the first side plate 21 and second side plate 22 substantially parallel when the holster 10 is in the closed position.

In the simpler embodiment, the user configures the holster 10 by inserting the removable hinge pin 16 through the open-ended elongated cooperative hinge knuckles 60 to axially connect the first side plate 21 to the second side plate 22, places a carried item such as a handgun 11 into the interior space 20 of the holster 10 in a preferred carry position then draws the first side plate 21 and the second side plate 22 together. The width of the holster 10 is then set by sliding the width lock 12 between the open-ended elongated cooperative hinge knuckles 60 until the first side plate 21 and the second side plate 22 are substantially parallel, then securing the width lock with the set screws 13 against the sides of the open-ended elongated cooperative hinge knuckles 60. An appropriately lengthened registration pin is then selected in order to accommodate the width of the carried item, upon which the registration pin 33 is positioned at the appropriate through-hole receptacles 27 of either of the first side plate 21 or the second side plate 22 within the interior space 20 such that the registration pin 33 fixes the position of the carried item within the interior space 20 in a preferred carry position, then loosely fitting the registration pin 33 with a screw 36. The registration pin 33 is then further adjusted by rotating it about its off-center receiving nut 34 to provide a snug fit against the trigger guard 103, and the screw 36 fully tightened. The user then places the holster in a concealed space while keeping the holster 10 in the closed position, such as inside the waistband (IWB), pocket, or other confined space. Since a latch is not present in the simpler embodiment, the user may easily retrieve the carried item by simply drawing it from the holster 10. Once the width lock 12 and registration pin 33 has been set for a specific handgun 11, securing and retrieval of the handgun 11 is simply accomplished by inserting the handgun 11 into the holster 10 and retrieving the handgun 11 from the holster 10 when desired. In a slight modification of this simpler embodiment, the registration pin 33 has a receiving nut 34 in both ends, not shown, for accepting a screw 36 from a through-hole receptacles 27 in each of the first side plate 21 and the second side plate 22, thus fixing the holster 10 in the closed position.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiments. The invention extends to any novel one, or any novel combination, of the features disclosed in this specification (including any accompanying claims, abstract and drawings), or to any novel one, or any novel combination, of the steps of any method or process so disclosed.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the foregoing illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A Holster for a user carried item comprising:

a first side plate and a second side plate, each of the first and second side plates comprising a plurality of through-hole receptacles, each of the first and second side plates further comprising a front portion and an adjacent top portion, wherein each front portion of each side plate comprises a plurality of cooperative hinge knuckles;

a removable hinge pin located through the plurality of cooperative hinge knuckles of each of the first and second side plates, thus joining both of the first and second side plates in a hinged relationship, wherein the joined first and second side plates define an interior space for the carried item, a first side plate exterior surface and a second side plate exterior surface; and a latch removably attached to at least one of the plurality of through-hole receptacles on either the first side plate or the second side plate in alignment with, and engageable with, a latch keeper removably attached to at least one of the plurality of through-hole receptacles on the opposing second side plate or first side plate, and configured such that the first side plate and the second side plate are substantially parallel when the latch engages the latch keeper.

2. The Holster of claim 1 further comprising at least one registration pin removably attached to at least one of the plurality of through-hole receptacles in either the first or second side plates within the interior space for securely locating the carried item.

3. The Holster of claim 1 further comprising a torsion spring located coaxial with the through-hole receptacles of the first and second side plates such that the spring biases the opening of the interior space of the holster.

4. The Holster of claim 1 further comprising a spring located orthogonal to and at a distance from the hinge pin connecting the first side plate to the second side plate such that the spring biases the opening of the interior space of the holster.

5. The Holster of claim 4 wherein the spring is a tension spring located orthogonal to and at a distance from the hinge pin opposite to the interior space of the holster.

6. The Holster of claim 4 wherein the spring is a compression spring located orthogonal to and at a distance from the hinge pin within the interior space of the holster.

7. The Holster of claim 1 wherein the latch is a draw latch comprising a spring-biased bolt, a push button, and a plunger in communication with the push button and the spring-biased bolt.

8. The Holster of claim 7 wherein the draw latch bolt is slideably attached to the draw latch plunger thus providing draw latch length adjustment.

9. The Holster of claim 8 wherein each of the plurality of cooperative hinge knuckles on either the first side plate or the second side plate further comprise a plurality of adjacent knuckles such that the interior space of the holster can be adjustably preset for a carried item through selective placement of the removable hinge pin and draw latch length adjustment.

10. The Holster of claim 8 wherein each of the plurality of cooperative hinge knuckles on either the first side plate or the second side plate comprise elongated cooperative hinge knuckles and further comprise a width lock such that the interior space of the holster can be adjustably preset for a carried item through selective placement of the width lock and draw latch length adjustment.

11. The Holster of claim 10 wherein the width lock comprises a circular knuckle and at least one set screw for securing the width lock's position in alignment with the plurality of elongated cooperative hinge knuckles.

12. The Holster of claim 1 wherein:

each of the plurality of cooperative hinge knuckles on either the first side plate or the second side plate comprise elongated cooperative hinge knuckles and further comprise a width lock, and the latch comprises a bolt slideably attached to a shaft such that the position of the bolt along the shaft is adjustable, the shaft comprising a spring-biased sliding-shaft gear in communication with a push-button comprising a complementary sliding-gear engaged with the spring-biased sliding-shaft gear, wherein depression of the push-button positions the bolt from an engaged position to a disengaged position from the keeper, wherein that the interior space of the holster can be adjustably preset for a carried item through selective placement of the width lock and position of the bolt along the shaft.

13. The Holster of claim 12 wherein the width lock comprises a circular knuckle and at least one set screw for securing the width lock's position in alignment with the plurality of elongated cooperative hinge knuckles.

14. The Holster of claim 1 wherein the top portions of each of the first side plate and the second side plate contain a notch for receiving a carried item such as a revolver pistol.

15. The Holster of claim 1 wherein the latch comprises an electrically operated lock.

16. The Holster of claim 1 wherein the latch comprises a biometrically operated lock.

17. The Holster of claim 1 further comprising a body mounting facility adapter on either of the first side plate exterior surface or the second side plate exterior surface for attaching the holster to a body mounting facilities such as paddles, clips, straps, frames and shrouds.

18. The Holster of claim 1 further comprising an attachment means on either of the first side plate exterior surface or the second side plate exterior surface for securing the holster in a user preferred position.

19. A Holster for an inside the waistband (IWB) carried item comprising:

a first side plate and a second side plate, each of the first side plate and the second side plate comprising a plurality of through-hole receptacles, each of the first side plate and the second side plate further comprising a front portion and an adjacent top portion, wherein each front portion of each side plate comprises a plurality of cooperative hinge knuckles, each of the plurality of cooperative hinge knuckles on either the first side plate or the second side plate comprise elongated cooperative hinge knuckles and a width lock;

a removable hinge pin located through the plurality of cooperative hinge knuckles of each of the first and second side plates, thus joining both of the first and second side plates in a hinged relationship, wherein the joined first side plate and the second side plate define an interior space for the carried item, a first side plate exterior surface and a second side plate exterior surface; and at least one registration pin removably attached to at least one of the plurality of through hole receptacles in at least one of the first side plate or the second side plate within the interior space for securely locating the carried item such that the interior space of the holster can be adjustably preset for a waistband carried item through selective placement of the width lock and selection of registration pin length.

20. A method of securing and retrieving a handgun or similar carried item in a holster in a preferred carry position, the holster comprising a first side plate and a second side plate, each side plate comprising a front portion; the first side plate front portion comprising at least one circular hinge knuckle and the second side plate front portion comprising at least one cooperative elongated hinge knuckle and a securable width lock; both plates having a plurality of through-hole receptacles for accepting a securable registration pin, the first side plate and the second side plate joined by a removable hinge pin inserted through the hinge knuckles on the first side plate and the second side plate; a spring biasing the separation of the plates about the hinge; and a length-adjustable latch on the first side plate, the length-adjustable latch aligned to engage with a keeper on the second side plate; wherein both side plates define an interior space, the method comprising:

placing a carried item into the interior space of the holster in a preferred carry position;

drawing the two slide plates together to secure the carried item within the interior space;

securing the width lock while holding the side plates in a substantially parallel configuration;

selecting an appropriately lengthened registration pin to accommodate the width of the carried item;

positioning and securing the registration pin at the appropriate through-hole receptacle of either of the side, plates such that the pin fixes the position of the carried item within the interior space in a preferred carry position;

adjusting the latch length to engage the keeper while holding the side plates in a substantially parallel configuration; and releasing the latch and retrieving the carried item from the interior space of the holster.

* * * * *